United States Patent [19]

Hankison

[11] Patent Number: 4,886,369

[45] Date of Patent: Dec. 12, 1989

[54] CONTINUOUS STATIC MIXING APPARATUS

[75] Inventor: Paul M. Hankison, Peters Township, Washington County, Pa.

[73] Assignee: ACT Laboratories, Inc., McMurray, Pa.

[21] Appl. No.: 348,973

[22] Filed: May 9, 1989

[51] Int. Cl.[4] ..... B01F 15/02

[52] U.S. Cl. ..... 366/165; 366/340

[58] Field of Search ..... 366/165, 167, 173, 177, 366/178, 336, 337, 338, 339, 340, 341, 176; 137/896, 897, 898

[56] References Cited

U.S. PATENT DOCUMENTS 4,218,012 8/1980 Hamza ..... 366/165

*Primary Examiner*—Robert W. Jenkins

*Attorney, Agent, or Firm*—Webb, Burden, Ziesenheim & Webb

[57] ABSTRACT

A mixing apparatus includes an elongated cylindrical mixing chamber having a hollow body and opposed end walls attached thereto and closing off the hollow body. A discharge port extends through the body and into the mixing chamber between the end walls. Each end wall has an inner face, an opposed outer face and a plurality of nozzle bores extending therethrough and spaced about the center of the end wall. The bores diverge outwardly toward the body at an angle relative to the longitudinal axis of the chamber. The bores are also skewed with respect to a radial line extending outwardly from the center of the end walls and the bores of each end wall are skewed in the same direction. In this manner, a fluid entering through the nozzle bores of one end wall will contact and mix thoroughly within the mixing chamber with a fluid entering through the nozzle bores of the other end wall.

8 Claims, 2 Drawing Sheets

CONTINUOUS STATIC MIXING APPARATUS

BACKGROUND OF THE INVENTION

1. Field of the Invention

This invention relates to an apparatus for mixing together a plurality of flowable materials, such as a liquid with another liquid, a liquid with a gas, a liquid with a dry granular or powder material, a liquid with solids in a slurry or a suspension, or various combinations of these materials.

2. Background Art

Mixers can be generally classified as either a continuous type or a batch type. In a continuous mixer, a plurality of flowable materials, such as liquids, gases, powders, and the like are supplied at a particular flow rate into a mixing chamber and are mixed by their velocity and turbulence or by mechanical stirring, or both. Known continuous mixers do not always provide sufficient contact between the molecules of the materials to effect complete mixing. If the object of the mixing is a reaction, such as when a reagent is added to adjust the chemistry of acidic mine water, more reagent than is needed for the reaction is used to compensate for the inefficiency in mixing and to achieve as much contact by the reagent as possible. The inefficiency of the mixer results in extra cost from the use of excess reagent as well as the energy involved in operating the mechanical mixer.

In a batch type of mixer, two or more materials are placed in a container and mixed together by stirring, rotation, tumbling or the like. It is also common to mix oxygen with liquids, such as contaminated water, by either surface, turbine or bubble aerators in conjunction with large settling ponds or tanks. Such batch type mixers have several disadvantages. The mixing is rather slow since the materials are fed into the mixer, then mixed for a time period until the entire volume is mixed, and then removed from the mixing chamber. These mixers are also generally large, especially so with settling ponds, since an entire batch is treated at one time. Moreover, batch mixers are not generally efficient in operation.

The mixer disclosed in my previously issued U.S. Pat. No. 4,647,212, entitled "Continuous, Static Mixing Apparatus", solved a number of problems with the prior art mixers. In particular, the mixer disclosed in this patent is a continuous type of mixer which efficiently and thoroughly mixes together a plurality of materials. The mixer is totally static in operation, includes no moving elements, requires little maintenance or downtime, and is relatively simple of construction. In addition, the mixer disclosed in my previously issued patent is flexible in design, can accommodate a variety of specific needs, and can be used in a Variety of system configurations.

However, there are a number of drawbacks to the specific structure disclosed in my Patent No. 4,647,212. In particular, the mixer disclosed in my patent takes a portion of the mixing chamber, between end walls and separate nozzle plates at each end, for entrance chambers or atria for the two incoming fluid streams. The mixing chamber must be made large enough to provide for these entrance chambers or atria between the end plates and the nozzle plates. Moreover, the specific structure includes separate nozzle plates which are mounted within the elongated, cylindrical hollow body of the mixer. Since the pressure of the incoming fluid is applied to the entire surface of the nozzle plates, these nozzle plates must be securely fastened within the hollow body. This is a particular problem where the circumference of each nozzle plate comes in contact with the inner surface of the hollow body. Moreover, the nozzle plates may flex at high pressures and weaken the fastening mechanism. Finally, since the atria or entrance chambers each extend for a considerable distance on either side of the inlets to the nozzle bores, this tends to result in pocketing or trapping of liquids between the end plates and the nozzle plates. This causes a considerable draining problem when the mixer is not in use.

Accordingly, it is an object of the present invention to utilize all of the advantages of the mixer disclosed in my Patent No. 4,647,212, yet overcome certain drawbacks in the particular mixer structure disclosed therein.

SUMMARY OF THE INVENTION

I have invented a mixing apparatus which includes an elongated cylindrical mixing chamber having a hollow body, first and second end walls attached thereto and closing off the hollow body and a discharge port extending through the body and into the mixing chamber. The discharge port is positioned longitudinally on the hollow body between the end walls. Each end wall has an inner face, an opposed outer face and a plurality of nozzle bores extending therethrough and spaced about the center of each end wall. The inner face of each end wall is directed toward the inner face of an opposed end wall. The bores diverge outwardly toward the body and at an angle relative to the longitudinal axis of the chamber as the bore extends from the outer face to the inner face. The bores are also skewed with respect to a radial line extending outwardly from the center of the end walls. Also, the bores of each end wall are skewed in the same direction, such that a fluid entering through the nozzle bores of one end wall will contact and mix thoroughly within the mixing chamber with a fluid entering through the nozzle bores of the other end wall. The mixed fluids will exit through the mixing chamber through the discharge port. Fluids passing through the bores have a component of motion outwardly toward the body of the mixing chamber, a component of motion inwardly toward an opposite end wall, a rotary component of motion relative to the radius of the mixing chamber, and a rotary component of motion in a direction opposite to that of fluids passing through the bores of an opposite end wall.

An additional fluid can be mixed within the chamber by further including an intake port extending through the hollow body and into the mixing chamber. The intake port is positioned longitudinally on the hollow body between the end walls and opposite the discharge port. The intake port is adapted to direct flowable materials into the mixing chamber. Each end wall can also include a mounting collar thereon which surrounds the plurality of nozzle bores and extends outwardly from the outer face of each end wall. Preferably, the mounting collars are formed integral with an associated end wall.

The bores diverge outwardly at an angle of from about 25° to about 35°, with the preferred angle of about 30°. The bores are skewed at an angle of from about 10° to about 20°, with a preferred angle of about 15°. The diameter of the discharge port is preferably larger than the diameter of the intake port.

DESCRIPTION OF THE PREFERRED EMBODIMENTS

Figure 1:
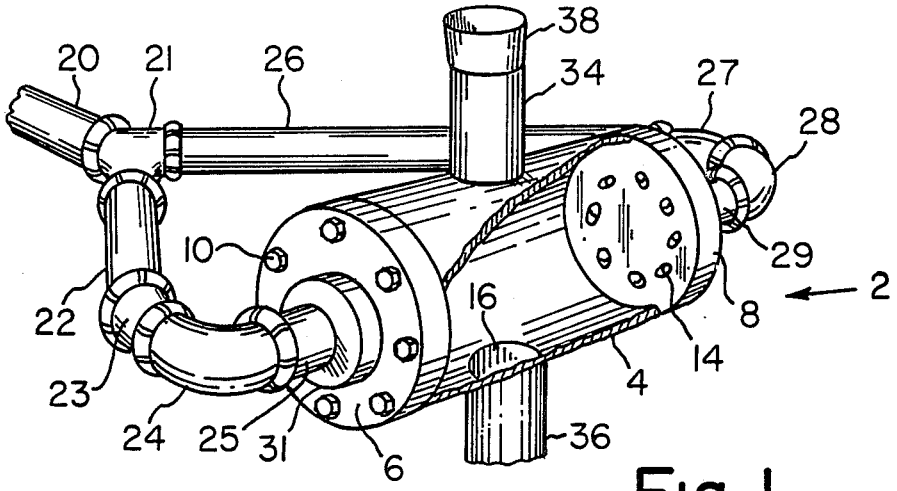
FIG. 1 is a perspective view of a first embodiment of the improved mixing apparatus in accordance with the present invention, partially broken away.
Figure 2:
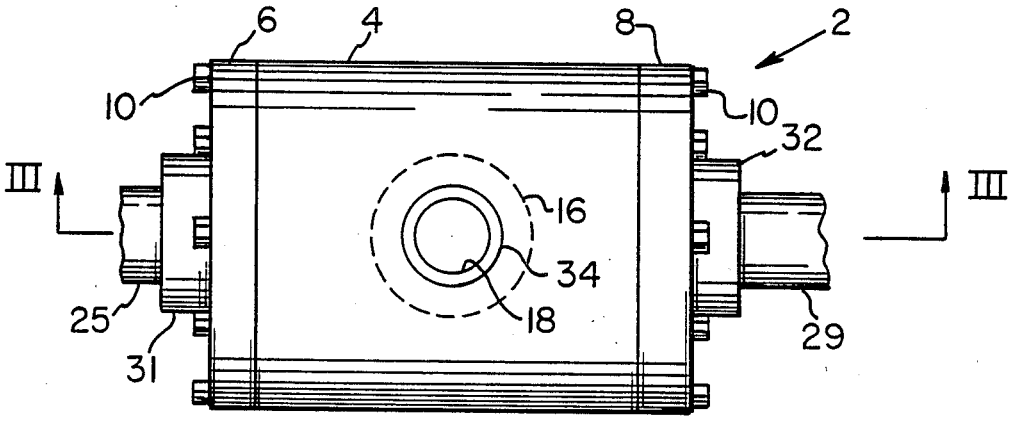
FIG. 2 is a top plan view of the mixer shown in FIG. 1.
Figure 3:
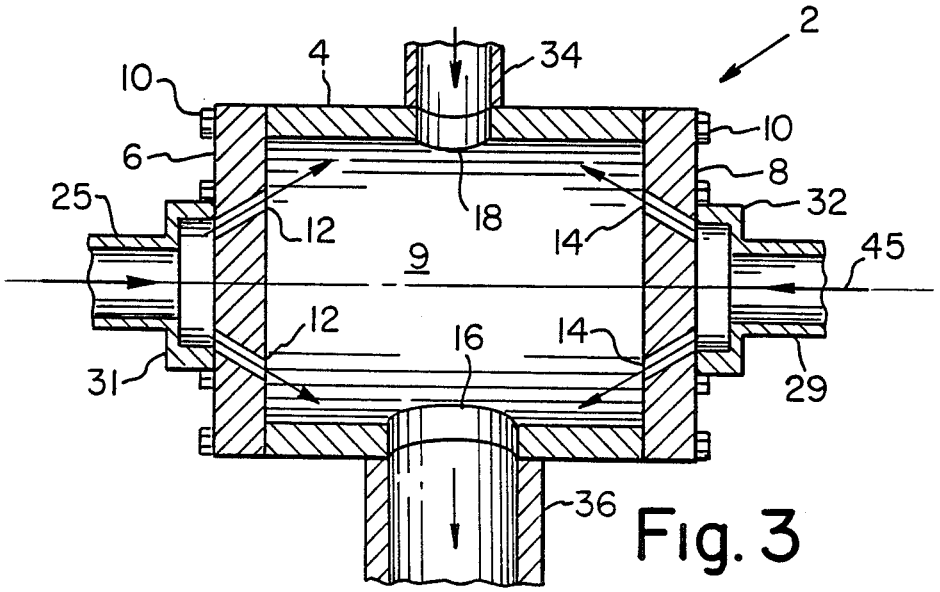
FIG. 3 is a section taken along lines III—III in FIG. 2.

A first embodiment of a mixer in accordance with the present invention is shown in FIGS. 1-3. Mixer 2 includes an elongated, cylindrical hollow body 4 which is closed off by a first outside end wall 6 at one outside end and by a second outside end wall 8 at the opposite outside end. No portion of the hollow body 4 extends outwardly beyond the first end wall 6 and the second end wall 8. Hollow body 4, first end wall 6 and second end wall 8 define and surround a hollow mixing chamber 9. The end walls 6, 8 may be welded to hollow body 4 or may be affixed thereto by bolts 10 as shown or by any other suitable fastening means. The first end wall 6 has a plurality of nozzle bores 12 extending therethrough. Similarly, the second end wall 8 has a plurality of nozzle bores 14 extending therethrough. The end walls and the nozzle bores extending therethrough will be described hereinafter in more detail in connection with FIGS. 4 and 5.

A discharge port 16 extends through the hollow body 4 and into the mixing chamber 9. The discharge port 16 is positioned longitudinally on the hollow body 4 between the first end wall 6 and the second end wall 8. The mixer 2 further includes an intake port 18 which extends through the hollow body 4 and into the mixing chamber 9. The intake port 18 is positioned longitudinally on the hollow body 4 between the first end wall 6 and the second end wall 8 and opposite the discharge port 16.

In the arrangement shown in FIGS. 1-3, the mixer 2 can be used to mix together two fluids within the mixing chamber 9. Although the term "fluid" is used to describe the materials mixed together in the mixer 2, it is to be understood that true fluids, such as liquids and gases, as well as other fluid-like or flowable materials, such as a dry granular or powder material, or a liquid with solids in a slurry or a suspension, or various combinations thereof, can be accommodated in the mixer 2 of the present invention. A first fluid can be supplied to the mixer 2 by way of intake conduit 20 which is connected to Y connector 21 which splits this fluid into two portions which are supplied at opposite ends of the mixer 2. A portion of the first fluid will flow out of one branch of the Y connector 21 through conduit 22, connector 23, elbow 24 and conduit 25. Similarly, the remainder of the first fluid will pass out of the other branch of Y connector 21 through conduit 26, connector 27, elbow 28, and conduit 29. Conduit 25 is attached to the first end wall 6 in fluid communication with the nozzle bores 12 extending therethrough.

If the inner diameter of conduit 25 is too small to completely surround all of the nozzle bores 12 through the first end wall 6, then conduit 25 can be provided with a wider, flared area 31, as shown, which completely encompasses the nozzle bores 12. Likewise, conduit 29 is attached to the second end wall 8 and in fluid communication with the nozzle bores 14 extending therethrough. Conduit 29 can also be provided with a flared area 32 which is affixed to the second end wall 8 and completely encompasses the nozzle bores 14 therethrough.

The fluid entering mixer 2 through the first end wall 6 will be split into a plurality of streams which are directed toward the middle of the mixing chamber 9. Similarly, the fluid entering mixer 2 through the second end wall 8 will be split into a plurality of streams which are directed toward the middle of the mixing chamber 9. The streams of fluid will collide in the middle of the mixing chamber 9 as shown by the arrows in FIG. 3.

A second fluid can be injected into the mixing chamber 9 of mixer 2 by means of an intake conduit 34 which is attached to the hollow body 4 and is in fluid communication with the intake port 18. Both the first and second fluids will be mixed together within the mixing chamber 9 and will pass out of the mixer 2 through the discharge port 16 and through a discharge conduit 36 which is attached to the hollow body 4 and is in fluid communication with the discharge port 16. The mixed fluid will then pass through the discharge conduit 36 to a desired location. The intake conduit 34 is particularly useful in supplying gases, particulate materials, or combinations thereof into the mixing chamber 9 of mixer 2. In the arrangement shown in FIG. 1, intake conduit 34 is set up for introducing a powdered material, a liquid or air directly into the interior of the mixer 2. A flange 38 may be provided at the free end of the intake conduit 34 to facilitate introduction of the air or powdered material into the mixer 2.

Figure 4:
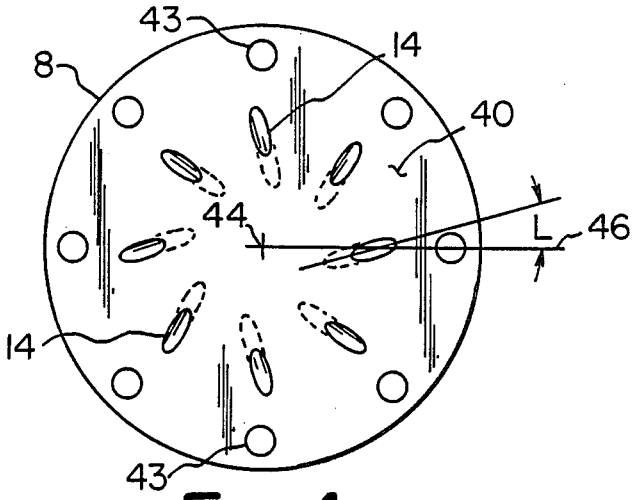
FIG. 4 is an elevational view of the inner face of one of the end walls shown in the mixer in FIG. 1.
Figure 5:
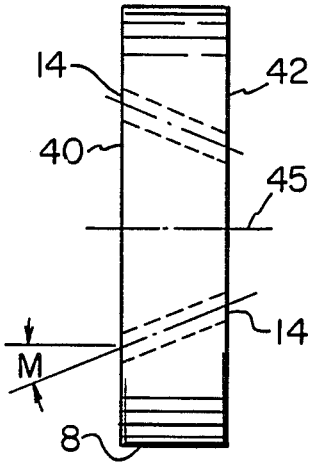
FIG. 5 is a side view of the end wall shown in FIG. 4.

The second end wall 8 used in the mixer 2 shown in FIGS. 1-3 is shown in more detail in FIGS. 4 and 5. The first end wall 6 is similar or identical to the second end wall 8 and need not be further described in detail. The second end wall 8 has an inner face 40 and an opposed and generally parallel outer face 42 opposite thereto. A plurality of nozzle bores 14 extend therethrough between the inner face 40 and the outer face 42 of the second end wall 8. When the end walls are positioned on the hollow body 4 of the mixer, the inner face of one end wall will be directed toward the inner face of the opposite end wall. Likewise, the outer faces of each end wall will be directed away from the mixing chamber 9. The second end wall can have a plurality of mounting holes 43 therethrough for mounting the second end wall 8 to the hollow body 4.

The nozzle bores 14 are generally spaced about the center 44 of the second end wall 8. As seen more clearly in FIG. 5, each bore 14 diverges outwardly toward the outer edge of the second end wall and, hence, toward the hollow body 4 as the bore 14 extends from the outer face 42 to the inner face 40. The bores 16 also diverge outwardly relative to the longitudinal axis 45 of the mixing chamber 9. The bores 14 diverge outwardly at an angle M as shown in FIG. 5. The bores 14 diverge outwardly at an angle from about 25° to about 35° and, in a preferred embodiment, diverge outwardly at an angle of about 30°. Since the bores 14 contact the faces 40, 42 of the end wall 8 at an angle, they will form ellipses on the surface thereof rather than circles which would result from a straight through bore. This inclination of the bores 14 will cause fluids flowing therethrough to have a component of motion outwardly toward the hollow body 4 and a component of motion inwardly toward an opposite end wall.

In addition, each bore 14 is skewed with respect to an imaginary line 46 which extends radially outwardly from the center 44 of the second end wall 8. By such skewing of the bores 14, fluids passing through the nozzle bores in the end walls will have a rotary component of motion relative to the radius of the mixing chamber 9. The bores 14 on an end wall should all be skewed in the same direction. It is preferred that the bores of each end wall be skewed along the same direction. When identical end walls are positioned opposite each other, fluid passing through the bores of one end wall will have a rotary component of motion in a direction opposite to a fluid passing through the bores of the opposite end wall. The angle of skewing of the bores 14 is shown in FIG. 4 by angle L. It is desirable that the bores 14 be skewed at an angle of from about 10° to about 20° preferably at an angle of about 15°.

As discussed above, fluid flowing against the outer face of each end wall 6, 8 in the vicinity of the nozzle bores will be broken up into a plurality of streams by means of the bores 12, 14 extending therethrough. In addition, each stream will be caused to flow both inwardly toward the middle of the mixing chamber 9 and outwardly toward the hollow body 4 and away from the longitudinal axis 45 extending through the mixing chamber 9. In addition, the skewing of the nozzle bores 12, 14 will cause the fluid streams to rotate in a spiral or twisting manner about the longitudinal axis 45 of the mixing chamber 9. It is desirable and highly preferred that the twisting action of the streams of fluid passing out of the nozzle bores 12, 14 of the end walls 6, 8 be oriented opposite of one another so that the streams hit each other in the middle of the mixing chamber 9 at a glancing angle. This can be accomplished by providing the first end wall 6 to be identical to the second end wall 8 and positioning them with their inner faces opposed to one another.

In the embodiment shown in FIGS. 1–3, the fluid passing out of the bores 12 in the first end wall 6 will be twisted in a clockwise manner while the fluid flowing out of the bores 14 in the second end wall 8 will be twisted in a counterclockwise manner. The streams will travel at such an angle so as to meet in the center and at the walls of the mixing chamber 9 in an intermingled fashion as to create a hydraulic sheer of the opposing fluid streams. The result is a highly turbulent mixing pattern since the shearing action tears the fluids into tiny particles which can easily be intermixed.

Figure 6:
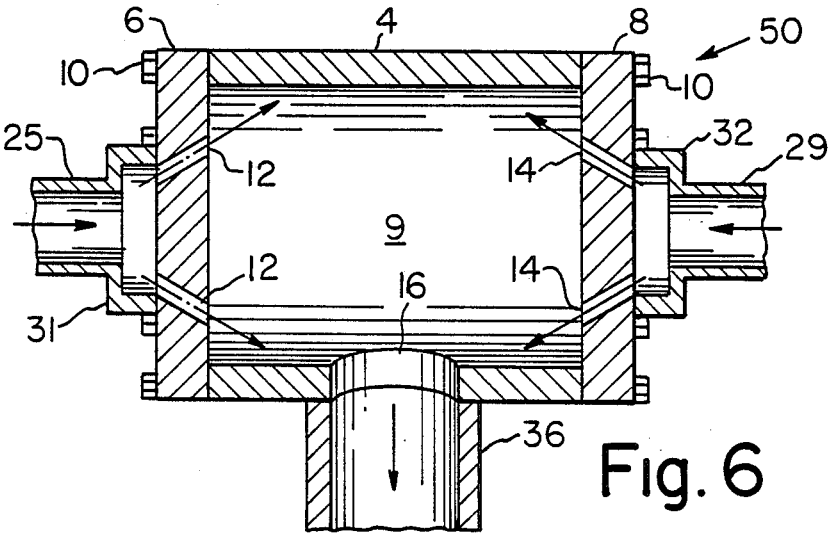
FIG. 6 is a sectional view, similar to FIG. 3, of a second embodiment of an improved mixing apparatus in accordance with the present invention.

A second embodiment of a mixer in accordance with the present invention is shown in FIG. 6. The mixer 50 is similar to the mixer 2 shown above in FIGS. 1–3 and like reference numbers will be used to identify like elements. The mixer 50 shown in FIG. 6 has only one difference from that shown in FIGS. 1–3. In the embodiment shown in FIG. 6, the cylindrical body 4 includes no intake port 18 therethrough. Mixer 50 is suited for mixing together two fluids which are moving under pressure through the end walls 6 and 8.

Figure 7:
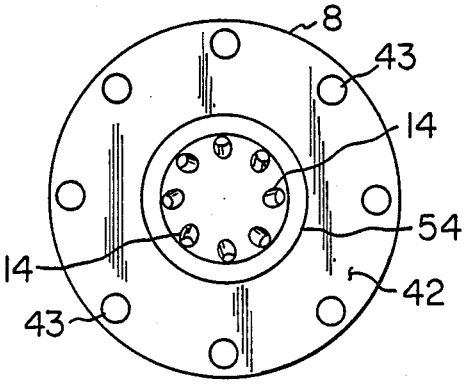
FIG. 7 is an elevational view of the outer face of an alternate arrangement of the end wall shown in FIG. 4.
Figure 8:
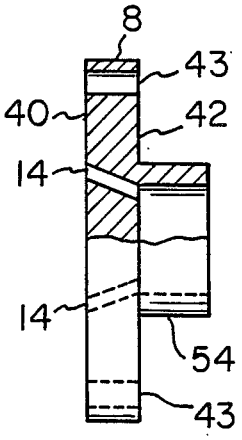
FIG. 8 is a side view, partially in section, of the end wall shown in FIG. 7.

An alternate embodiment of the second end wall 8 shown in FIGS. 4 and 5 is shown in FIGS. 7 and 8. Since these two embodiments are similar, like reference numbers will be used to refer to like elements in both. The second end wall 8 shown in FIGS. 7 and 8 includes a cylindrical collar 54 formed integral therewith and extending outwardly from the outer face 42 of the second end wall 8. The collar 54 is spaced slightly away from and completely surrounds the nozzle bores 14 extending through the second end wall 8. Collar 54 provides a mechanism whereby an inlet conduit having a sufficiently large inner diameter can be mounted directly to the end walls without the necessity of a wider flared area on the end of the conduit. It can be appreciated that any mechanism which connects the inlet conduit to the end walls and supplies fluid to the area on the outer face of the end walls containing the nozzle bores can be used in this invention.

The present arrangement is an improvement over the apparatus disclosed in my prior U.S. Pat. No. 4,647,212. The mixer efficiency of this apparatus is greatly improved by increasing the fluid velocity through the nozzle bores at a particular inlet pressure. The nozzle discharge coefficient governs the rate of flow, and thus the fluid velocity, through the nozzle bores. An increase in the nozzle bore discharge coefficient increases the rate of flow through the nozzles. The value of the nozzle bore discharge coefficient depends primarily upon the Reynold's number of the inlet conduit to the nozzle bores. An increase in the Reynold's number therefore increases the nozzle bore discharge coefficient. The Reynold's number for the end walls shown in the Figures can be calculated as follows:

$$N_{RE} = \frac{4 \times W}{\pi \times \mu \times D} \text{; where}$$

$N_{RE}$ = Reynold's number.
$W$ = mass flow rate.
$\pi$ = a mathematical constant.
$\mu$ = fluid viscosity.
$D$ = inside diameter.

In this arrangement, the Reynold's number is increased since the value of D, the inside diameter of the inlet conduit, is reduced from the diameter of the nozzle plate in the arrangement shown in U.S. Pat. No. 4,647,212, to the diameter of the inlet conduit connected to the end walls in the present application. The diameter of the inlet conduit herein or the flared area is only sufficient to enclose the nozzle bores of the end walls. This results in a smaller value of D in the Reynold's number equation given above. Since the value of D is reduced, the Reynold's number is increased, the nozzle bore discharge coefficient is increased and the mixing efficiency is improved.

The present arrangement has a number of other advantages over the specific arrangement disclosed in my U.S. Pat. No. 4,647,212. Since the atria between the separate nozzle plates and the end walls are eliminated, the overall mixing chamber length and volume can be reduced. The present arrangement also reduces parts and associated costs since the nozzle bores have been provided through the end walls, thus eliminating the need for separate nozzle plates and end walls. By eliminating the atria, the present arrangement eliminates pocketing or trapping of liquids between the end plates and the nozzle plates. This arrangement provides for simplified draining when the mixer is not in service. In addition, the force applied on the end walls from fluid pressure is reduced since the area subjected to the fluid pressure is only that of the inlet conduit opening to the end walls as opposed to the entire face area of the nozzle plate. This permits the use of simpler, smaller and less rugged connective joints and seals which were required to connect the separate nozzle plates to the interior of the hollow body. Moreover, the reduced force on the end walls in the present arrangement reduces the possible flexing of the end walls and the inducing of stress on any connective device.

Having described hereinabove the preferred embodiments of the present invention, it is to be understood that the invention may be otherwise embodied within the scope of the appended claims.

I claim:

1. A mixing apparatus comprising an elongated cylindrical mixing chamber having a hollow body, first and second outside end walls attached at each outside end thereto and closing off said hollow body, with no portion of said hollow body extending outwardly beyond said end walls, and a discharge port extending through said body and into said mixing chamber, said discharge port positioned longitudinally on said hollow body between said end walls, with each end wall having an inner face, an opposed outer face, and a plurality of nozzle bores extending therethrough into the mixing chamber between said inner face and outer face and spaced about the center of each said end wall, with the inner face of each end wall directed toward the inner face of an opposed end wall, and a mounting collar affixed to and extending outwardly from an outer face of each of said end walls, with said mounting collars surrounding said plurality of nozzle bores in said associated end wall and having an inner diameter only large enough to completely enclose the nozzle bores, with said bores each diverging outwardly toward said body and at an angle relative to the longitudinal axis of the chamber as the bore extends from said outer face to said inner face, with said bores being skewed with respect to a radial line extending outwardly from the center of said end walls, and with said bores of each end wall being skewed in the same direction, such that a fluid entering through the nozzle bores of one end wall will contact and mix thoroughly within said mixing chamber with a fluid entering through the nozzle bores of the other end wall and the mixed fluids will exit said mixing chamber through said discharge port, whereby fluids passing through said bores have a component of motion outwardly toward said body of said mixing chamber, a component of motion inwardly toward an opposite end wall, a rotary component of motion relative to the radius of said mixing chamber, and a rotary component of motion in a direction opposite to that of fluids passing through the bores of an opposite end wall.

2. The mixing apparatus as set forth in claim 1 further including an intake port extending through said body and into said mixing chamber, said intake port positioned longitudinally on said hollow body between said end walls and opposite said discharge port, said intake port adapted to direct flowable materials into said mixing chamber.

3. The mixing apparatus as set forth in claim 2 wherein said discharge port has a diameter larger than the diameter of said intake port.

4. The mixing apparatus as set forth in claim 1 wherein said bores diverge outwardly at an angle of from about 25° to about 35°.

5. The mixing apparatus as set forth in claim 4 wherein said bores diverge outwardly at an angle of about 30°.

6. The mixing apparatus as set forth in claim 1 wherein said bores are skewed at an angle of from about 10° to about 20°.

7. The mixing apparatus as set forth in claim 1 wherein said bores are skewed at an angle of about 15°.

8. The mixing apparatus as set forth in claim 1 wherein each said mounting collar is formed integral with said associated end wall.

* * * * *

UNITED STATES PATENT AND TRADEMARK OFFICE

CERTIFICATE OF CORRECTION

PATENT NO. : 4,886,369

DATED : December 12, 1989

INVENTOR(S) : Paul M. Hankison

It is certified that error appears in the above-identified patent and that said Letters Patent is hereby corrected as shown below:

On the title page;

Under References Cited U.S. PATENT DOCUMENTS insert
--4,647,212 3/1987 Hankison ... 366/165--.

Column 1 Line 55 "Variety" should read --variety--.

Signed and Sealed this

Eighteenth Day of December, 1990

*Attest:*

HARRY F. MANBECK, JR.

*Attesting Officer*

*Commissioner of Patents and Trademarks*